US012663182B2

(12) United States Patent
Murphy

(10) Patent No.: US 12,663,182 B2
(45) Date of Patent: Jun. 23, 2026

(54) FLEXIBLE CONNECTORS FOR WATER HEATER

(71) Applicant: A. O. SMITH CORPORATION, Milwaukee, WI (US)

(72) Inventor: Mark Murphy, Nashville, TN (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 211 days.

(21) Appl. No.: 18/654,880

(22) Filed: May 3, 2024

(65) Prior Publication Data

US 2024/0295342 A1 Sep. 5, 2024

Related U.S. Application Data

(63) Continuation of application No. 17/820,528, filed on Aug. 17, 2022, now Pat. No. 12,007,147.

(60) Provisional application No. 63/234,758, filed on Aug. 19, 2021.

(51) Int. Cl.

| | |
|---|---|
| ***F16L 23/02*** | (2006.01) |
| ***F24H 9/02*** | (2006.01) |
| ***F24H 9/13*** | (2022.01) |

(52) U.S. Cl.

CPC ..... *F24H 9/136* (2022.01); *F24H 9/02* (2013.01)

(58) Field of Classification Search

CPC ... F16L 5/00; F16L 21/03; F16L 37/54; F16L 21/005; F16L 37/113; F16L 37/252; F16L 23/02; F16L 23/08

See application file for complete search history.

(56) References Cited

U.S. PATENT DOCUMENTS 3,093,161 A * 6/1963 Jacobsen ..... F24H 9/133 138/143
3,116,402 A * 12/1963 Drugmand ..... H05B 3/06 411/116
4,991,876 A * 2/1991 Mulvey ..... E03C 1/025 285/915
5,024,419 A * 6/1991 Mulvey ..... E03C 1/021 285/332.1

(Continued)

FOREIGN PATENT DOCUMENTS

CN 1690587 A * 11/2005 ..... F24H 9/13
CN 109579285 A * 4/2019 ..... F24H 9/02

(Continued)

*Primary Examiner* — Gregory A Wilson

(74) *Attorney, Agent, or Firm* — Michael Best & Friedrich LLP

(57) ABSTRACT

A water heater includes a tank defining an interior space adapted to contain water and a shroud over the water heater and defining a component space inside the shroud. A first pipe nipple is coupled to a spud of the water heater, the first pipe nipple and spud defining a non-collinear axis that is non-collinear with a pipe axis of a pipe to be fluidly connected to the tank. A flexible connector is connected at one end to the first pipe nipple along the non-collinear axis. A second end of the flexible connector is positioned collinear with the pipe axis. A second pipe nipple is coupled at one end to the second end of the flexible connector and coupled at an opposite end with the pipe. Fluid communication is established between the pipe and the interior space of the tank through the pipe nipple and flexible connector.

19 Claims, 9 Drawing Sheets

(56) References Cited

U.S. PATENT DOCUMENTS

| | | | | | |
|---|---|---|---|---|---|
| 5,165,732 | A * | 11/1992 | Townsend | F23J 13/04 | 126/307 R |
| 5,364,135 | A * | 11/1994 | Anderson | F16L 19/0212 | 285/38 |
| 5,899,236 | A * | 5/1999 | Coronado | F16L 11/10 | 138/109 |
| D617,429 | S | 6/2010 | Govoni et al. | | |
| D632,372 | S | 2/2011 | Govoni et al. | | |
| 8,245,987 | B2 * | 8/2012 | Hazzard | F24H 15/414 | 248/217.4 |
| 8,991,638 | B2 * | 3/2015 | Nelson | F28D 15/00 | 220/567.3 |
| 9,360,149 | B2 * | 6/2016 | Lesage | F24H 9/133 | |
| 9,976,928 | B2 * | 5/2018 | Strait | E21B 1/00 | |
| 10,156,382 | B2 | 12/2018 | Passerell | | |
| D837,346 | S | 1/2019 | Lee | | |
| 10,215,445 | B1 * | 2/2019 | Mottershead | F28D 20/0034 | |
| 10,281,171 | B2 * | 5/2019 | Shaffer | F24H 4/04 | |
| 11,365,836 | B2 * | 6/2022 | De Lemos Junior | F16L 23/003 | |
| D1,054,282 | S | 12/2024 | Park | | |
| D1,067,391 | S | 3/2025 | Huang | | |
| D1,078,947 | S | 6/2025 | Reinhart | | |
| D1,093,558 | S * | 9/2025 | Murphy | D23/262 | |
| 2004/0127084 | A1 * | 7/2004 | Glennie | E21B 33/0385 | 439/316 |
| 2015/0168013 | A1 * | 6/2015 | Rodriguez | F24H 1/182 | 220/694.1 |
| 2016/0084525 | A1 * | 3/2016 | Rissler | F25B 1/005 | 62/238.7 |
| 2016/0109154 | A1 * | 4/2016 | Shaffer | F24H 4/04 | 122/15.1 |

FOREIGN PATENT DOCUMENTS

| | | | | |
|---|---|---|---|---|
| DE | 102019116387 | A1 * | 12/2020 | F16L 23/18 |
| EP | 3809061 | A1 * | 4/2021 | F24H 4/04 |
| FR | 3101936 | A1 * | 4/2021 | F28D 7/12 |
| GB | 2504082 | A * | 1/2014 | F24H 1/48 |
| GB | 2554463 | A * | 4/2018 | F16L 23/003 |
| KR | 20050033079 | A * | 4/2005 | B67D 1/0859 |
| KR | 20090033543 | A * | 4/2009 | F16L 23/02 |
| KR | 20170002668 | U * | 7/2017 | F16L 23/02 |

* cited by examiner

FLEXIBLE CONNECTORS FOR WATER HEATER

CROSS-REFERENCE TO RELATED APPLICATIONS

This application is a continuation application of U.S. patent application Ser. No. 17/820,528 filed Aug. 17, 2022, and claims priority to U.S. provisional patent application No. 63/234,758, filed on Aug. 19, 2021, the contents of which are hereby incorporated by reference in their entirety.

BACKGROUND

The present invention relates to a tank-type water heater having a relatively large space between the top of the tank and the top of a shroud over the tank. The shroud encloses a component space over the tank to accommodate components of a heat pump or other components relating to the operation of the water heater. Such water heaters include hot and cold water spuds in the top of the tank to permit the ingress and egress of water with respect to an interior space of the tank. The spuds are enclosed in the component space. The cold water and hot water pipes for the water heater terminate outside of the shroud to make installation most convenient. Such configurations therefore result in a relatively large gap in the component space between the spuds and pipes. It is known to span the component space with relatively long pipe nipples. In such configurations, each long pipe nipple is coupled at one end to one of the spuds (hot or cold) inside the shroud and is coupled at an opposite end to the associated pipe (hot or cold) outside of the shroud.

SUMMARY

An aspect of the invention provides a water heater for connection to a pipe defining a pipe axis, the water heater comprising: a tank having a tank wall defining an interior space adapted to contain water; a shroud defining a component space over the tank; a heat source operable to heat the water; and a flexible connector extending through the component space and having a first end communicating with the interior space of the tank and a second end communicating through a top end of the shroud; wherein the first end of the flexible connector defines a non-collinear axis that is non-collinear with the pipe axis and the second end of the flexible connector defines a collinear axis that is collinear with the pipe axis.

In some embodiments, the water heater further comprises a first rigid connector in the component space, the first rigid connector being collinear with the non-collinear axis and communicating between the first end of the flexible connector and the interior space of the tank. In some embodiments, the water heater further comprises a spud rigidly mounted to the tank wall and defining the non-collinear axis, the first rigid connector being rigidly mounted to the spud. In some embodiments, the first rigid connector comprises a pipe nipple having a first end in threaded engagement with the spud and a connector having a first port in threaded engagement with a second end of the pipe nipple and a second port in threaded engagement with the first end of the flexible connector. In some embodiments, the water heater further comprises a mixing valve arranged within the component space, one of an inlet and an outlet of the mixing valve communicating with a third port of the connector. In some embodiments, the water heater further comprises a second rigid connector outside of the component space, the second rigid connector being collinear with the collinear axis and communicating with the second end of the flexible connector. In some embodiments, each of the first and second rigid connectors comprise pipe nipples. In some embodiments, the water heater further comprises a torque carrier having a loadbearing surface that engages the second end of the flexible connector and prevents rotation of the second end of the flexible connector with respect to the shroud. In some embodiments, the second end of the flexible connector comprises a hex nut and the torque carrier includes a hex socket into which the hex nut is received. In some embodiments, the torque carrier is integrally formed with the shroud or is mounted to the shroud. In some embodiments, the torque carrier includes a sleeve extending perpendicular to the shroud and defining the loadbearing surface. In some embodiments, the sleeve extends into the component space. In some embodiments, the torque carrier includes a base mounted to the shroud and a sleeve extending perpendicular to the base. In some embodiments, at least a portion of the heat source is within the component space. In some embodiments, the water heater further comprises a mixing valve positioned within the component space and in fluid communication with the first end of the flexible connector.

Another aspect of the invention provides a method of making a water heater comprising: threading a first end of a first rigid connector into a spud arranged at a top end of a tank; connecting a first end of a flexible connector to a second end of the first rigid connector; receiving a second end of the flexible connector into a torque carrier; and connecting a second rigid connector to the second end of the flexible connector.

In some embodiments, connecting the second rigid connector to the second end of the flexible connector comprises applying a torque, and wherein the torque is resisted by the torque carrier. In some embodiments, the method further comprises fastening the torque carrier to a shroud wall of the water heater. In some embodiments, fastening the torque carrier to the shroud wall is performed after receiving the second end of the flexible connector into the torque carrier. In some embodiments, the method further comprises connecting a mixing valve to the first rigid connector.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
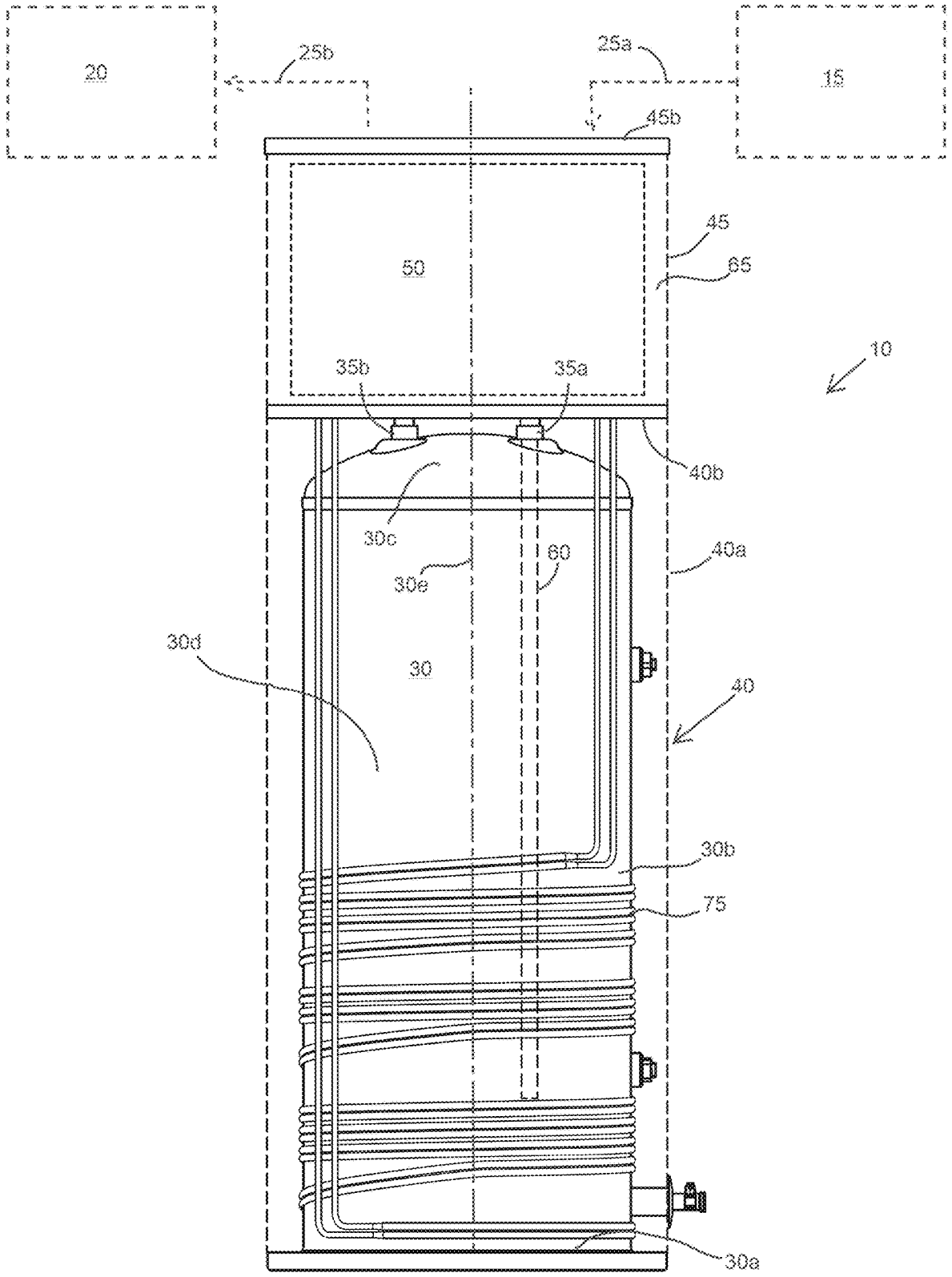
FIG. 1 is a side view of a tank-type water heater according to some embodiments of the invention.

FIG. 1 illustrates a water heater construction. The water heater 10 is a tank-type water heater for receiving cold water from a water source 15, heating the cold water to produce hot water, and delivering the hot water to an end user 20. The water to be heated (referred to as "cold water" although it could be warm water that is being recirculated to bring it up to set temperature) is delivered to the water heater 10 from the cold water source 15 or recirculation loop by way of a cold water pipe 25*a*. The hot water is delivered from the water heater 10 to the end user 20 by way of a hot water pipe 25*b*. The term "pipe" includes any suitable conduit and the term "end user" includes people and appliances that make use of the hot water. The cold water pipe 25*a* and the hot water pipe 25*b* and are generically referred to as a water pipe 25 in the following description and claims.

The water heater 10 includes a tank 30, an inlet spud 35*a*, an outlet spud 35*b*, a jacket 40, a shroud 45, and a heat source 50. The illustrated tank 30 is cylindrical and includes a bottom head 30*a*, a cylindrical tank sidewall 30*b*, and a top head 30*c* which together define an interior space 30*d* which holds hot water. The cylindrical tank sidewall 30*b* defines central axis 30*e* that is vertical in the illustrated embodiment. The top head 30*c* is dome shaped, defining a convex outer top surface facing upward and having generally horizontal flat surfaces for attachment of the inlet spud 35*a* and outlet spud 35*b*. The bottom head 30*a*, tank sidewall 30*b*, and top head 30*c* are individually and collectively referred to as a "wall of the tank" and "tank wall". The interior space 30*d* includes a lower portion proximate the bottom head 30*a* and an upper portion proximate the top head 30*c*.

Figure 5:
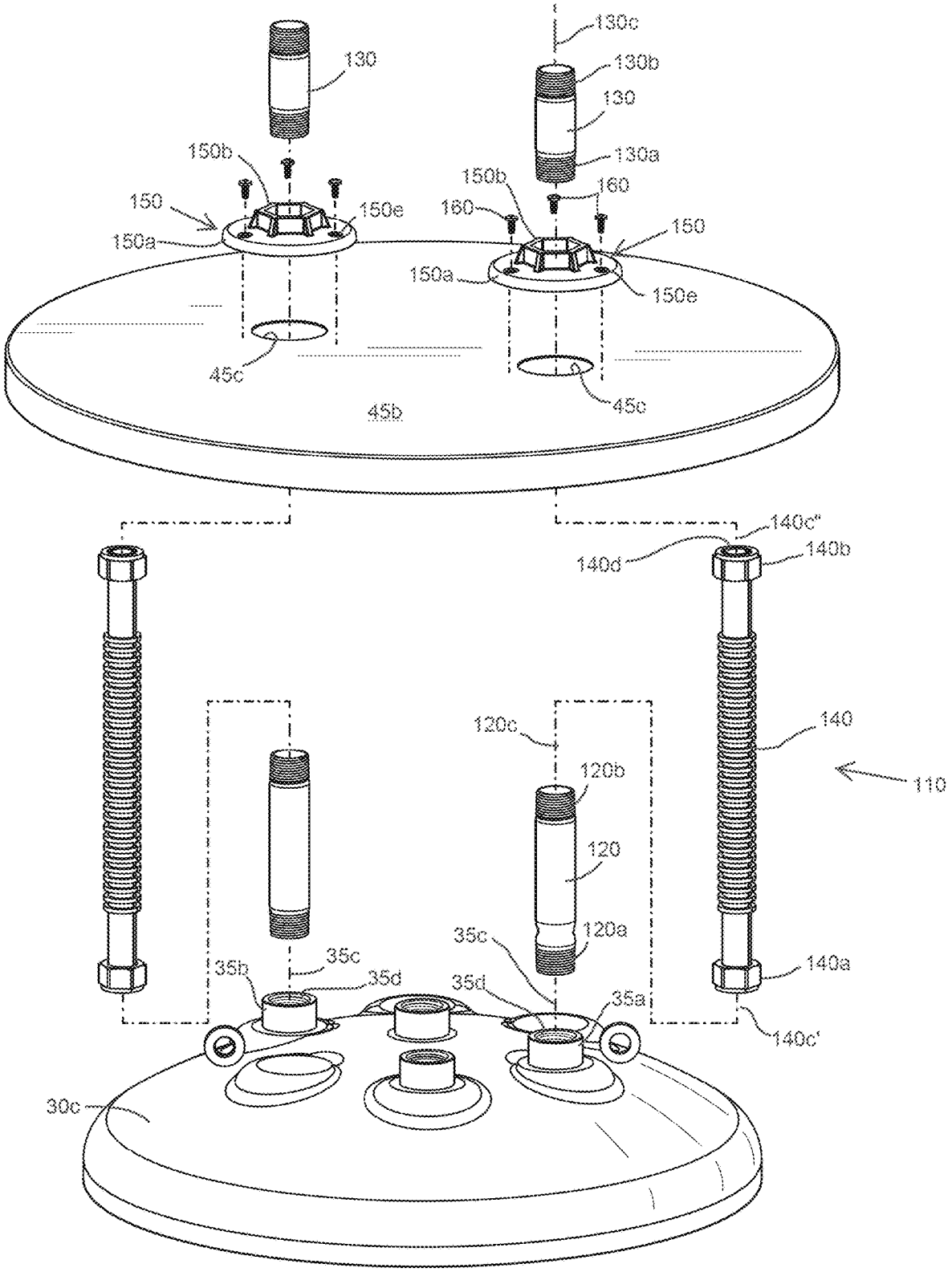
FIG. 5 is an exploded view of the second embodiment.

The inlet spud 35*a* and outlet spud 35*b* are identical to each other and are generically referred to as a spud 35 or the spuds 35. Each spud 35 is welded to the tank wall (e.g., the top head 30*c* in the illustrated embodiment) over a hole that provides access to the interior space 30*d* of the tank 30. Each spud 35 is cylindrical and defines a spud axis 35*c* (FIG. 2) that is centered on (collinear with) internal (female) threads 35*d* (FIG. 5). A dip tube 60 extends from the inlet spud 35*a* to the lower portion of the interior space 30*d* to deliver the cold water to the lower portion. Hot water flows out of the upper portion of the interior space 30*d* through the outlet spud 35*b*.

Figure 2:
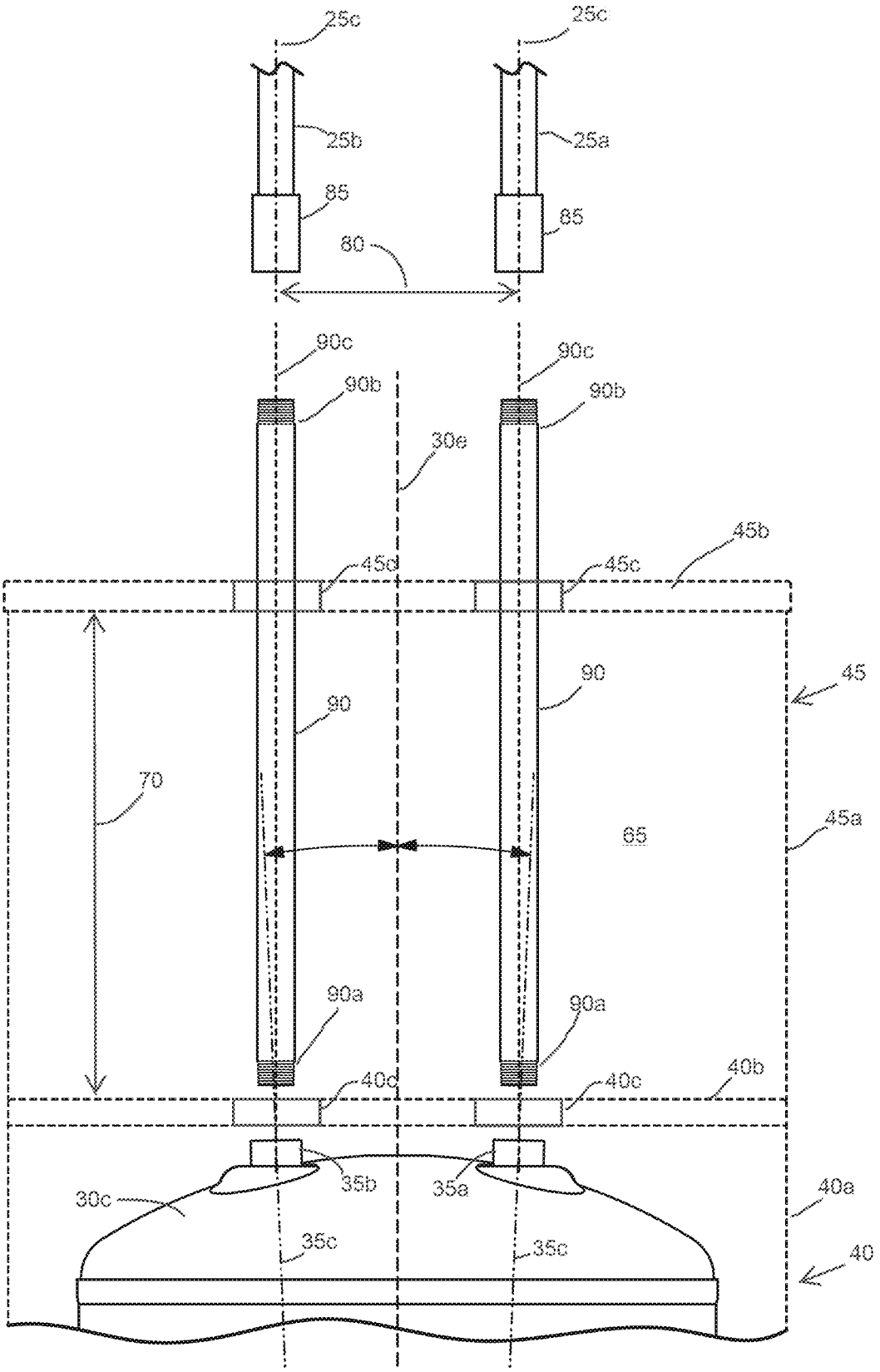
FIG. 2 is an exploded view of a portion of a tank-type water heater according to a first embodiment of the present invention.

A side portion 40*a* of the jacket 40 surrounds the tank sidewall 30*b* and a top portion 40*b* of the jacket 40 extends over the top head 30*c* of the tank 30. An annular space is defined between the side portion 40*a* of the jacket 40 and the tank sidewall 30*b* and an overhead space is defined between the top portion 40*b* of the jacket 40 and the top head 30*c* of the tank 30. Foam insulation fills the annular space and overhead space to insulate the tank 30. As illustrated in FIG. 2, jacket through-holes 40*c* are formed in the top portion 40*b* of the jacket 40 to provide access to the spuds 35.

Turning now to FIG. 2, the shroud 45 sits atop the jacket 40 and includes a shroud sidewall 45*a* and a shroud top 45*b*. The shroud sidewall 45*a* and shroud top 45*b* are collectively referred to as a shroud wall. The shroud 45 is constructed of a relatively thin gauge metal with a primarily aesthetic purpose of covering components (functional or structural) of the water heater 10 within the shroud 45. In other embodiments the shroud 45 can be constructed of plastic or another suitable material that meets this aesthetic purpose. A component space 65 is defined between the top portion 40*b* of the jacket 40, the shroud sidewall 45*a*, and the shroud top 45*b*. The shroud top 45*b* includes a pair of shroud through-holes 45*c*. The shroud through-holes 45*c* are aligned with the jacket through-holes 40*c* in the illustrated embodiment and are positioned over the spuds 35 to provide access to the spuds 35 through the top portion 40*b* of the jacket 40. As used herein, "aligned" means that centerlines of the jacket through-holes 40*c* and shroud through-holes 45*c* (i.e., centerlines perpendicular to the planes of the respective through-holes) are collinear. The distance between the jacket through-holes 40*c* and the shroud through-holes 45*c* is referred to as the "gap" 70 of the component space 65.

With reference again to FIG. 1, the heat source 50 is illustrated schematically for simplicity. The illustrated heat source 50 comprises a heat pump having certain components such as a compressor and evaporator in the component space 65 and a condenser coil 75 adhered to the tank sidewall 30*b* with thermally-conductive paste, by brazing, or by another means that promotes heat transfer from the condenser coil 75 to the water in the tank 30 through the tank sidewall 30*b*. In other embodiments, the condenser coil 75 can be submerged in the water in the tank 30, provided that relevant codes are complied with. In other embodiments, the condenser can be a liquid-to-refrigerant heat exchanger arranged, for example, in the component space 65, with water connections in fluid communication with the interior space 30*d* to allow water from the tank to be circulated through the heat exchanger. In other embodiments, an alternative heat source may be employed, with certain components of the alternative heat source in the components space. Such alternative heat sources of other embodiments can comprise a power burner forcing products of combustion through the tank wall, for example, in combination with one or more flue tubes in the tank 30. Another alternative heat source can comprise one or more electric heating elements. In other embodiments, the heat source 50 can be waste heat from another device or any other device that generates heat. In other embodiments, components unrelated to the heat source 50, such as a recirculation pump or a mixing valve, can be positioned in the component space 65 with or without components of the heat source 50 also being the component space 65.

Referring again to FIG. 2, each pipe 25 includes free ends outside of the component space 65 to facilitate installation of the water heater 10. As such, the pipes 25 terminate outside of the shroud 45 and the free ends are spaced from each other a standard distance 80 which is equal to the distance between the spud axes 35*c*. Each pipe 25 defines a pipe axis 25*c* that is aligned with the associated jacket through-hole 40*c* and shroud through-hole 45*c*. The pipe axis 25*c* is vertical (i.e., parallel to the central axis 30*e*) in the illustrated embodiment. The free end of each pipe 25 includes a pipe connector 85 that is rotatable about the pipe axis 25*c* with respect to the pipe 25. The pipe connectors 85 have female threads 140*d* (FIG. 5) for threading onto the male threads of an end of a pipe nipple. After the pipe connectors 85 are threaded onto the pipe nipples, the pipe connectors 85 are affixed by soldering or another suitable means to the pipes 25 to prevent the join.

With continued reference to FIG. 2, the hot side and cold side each have a long pipe nipple 90 that spans the gap 70 of the component space 65. Pipe nipples are well-known in the plumbing art as short lengths of pipe with male pipe threads at either end, used to connect other plumbing fittings to one another. Generally speaking, pipe nipples are readily available at standard nominal pipe sizes in lengths up to twelve inches. Pipe nipples in lengths exceeding twelve inches (such as the long pipe nipple 90) are not generally available, but can be fabricated as ready cut pipe with threads formed on either end. The long pipe nipples 90 are identical to each other. The long pipe nipple 90 includes a first (lower) male threaded end 90*a* and a second (upper) male threaded end 90*b* and defines a long pipe nipple axis 90*c*.

Figure 3:
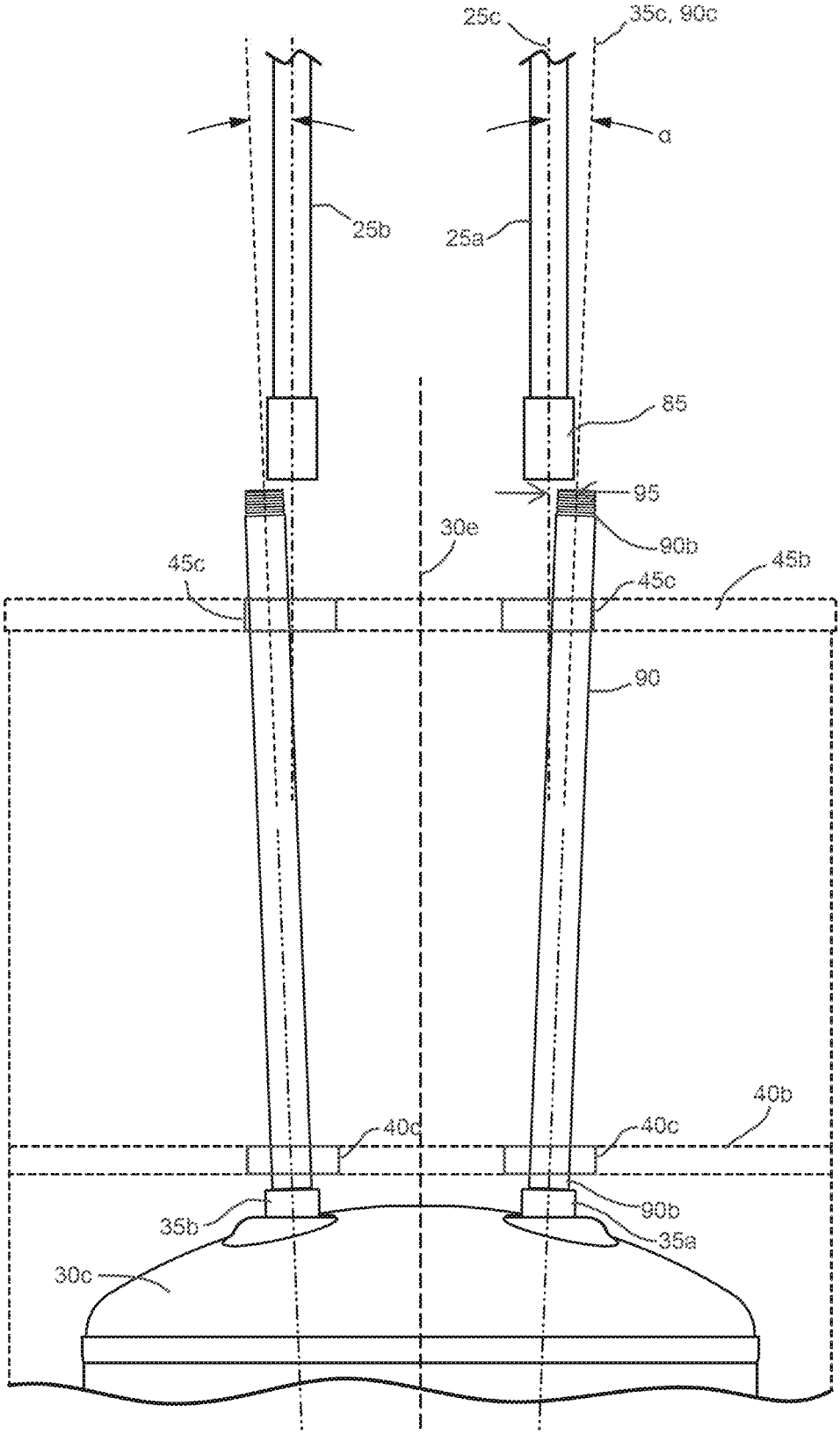
FIG. 3 is a side view of the first embodiment illustrating an installation step.
Figure 4:
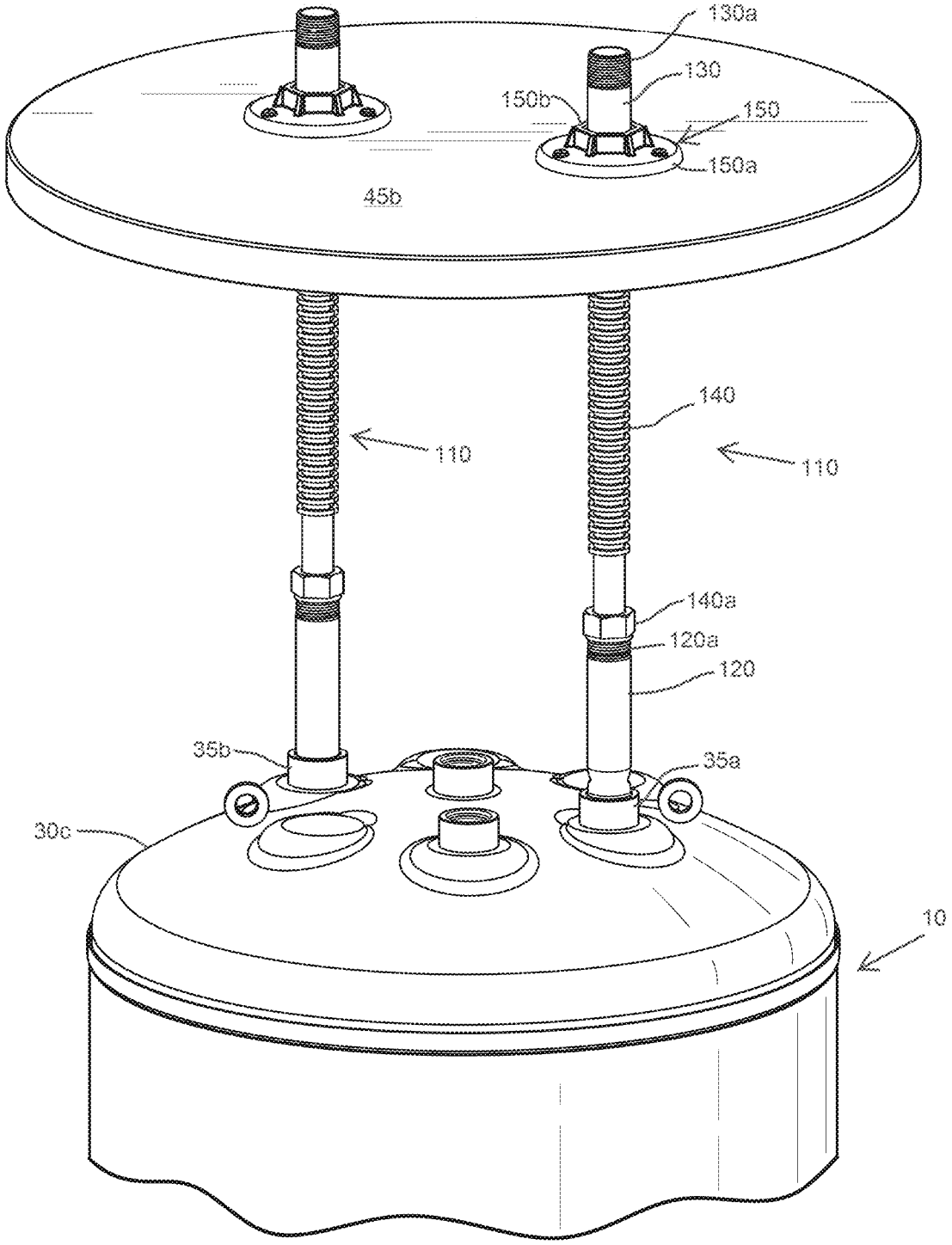
FIG. 4 is a top perspective view of a top portion of a tank-type water heater according to a second embodiment of the present invention.

With reference to FIG. 3, during manufacture or installation the first end 90*a* of the long pipe nipple 90 is threaded into the spud 35, such that the long pipe nipple axis 90*c* is colinear with the spud axis 35*c*. The long pipe nipple 90 extends through the jacket through-hole 40*c* and the shroud through-hole 45*c*. The pipe connector 85 is threaded onto the second end 90*b* of the long pipe nipple 90 and then the pipe connector 85 is affixed to the pipe 25 by soldering to prevent the joint from loosening. Once installed, the long pipe nipple 90 establishes fluid communication between the pipe 25 and the interior space 30*d* of the tank 30 through the spud 35.

While a water heater construction according to the first embodiment may be satisfactory when the gap 70 is small, installation challenges can occur as the gap required to accommodate the heat source 50 increases. With generally accepted manufacturing tolerances, the spud axis 35*c* may not be collinear with the pipe axis 25*c*. For example, acceptable manufacturing tolerances result in a range of variance of the spud axis 35*c* from the pipe axis 25*c* of +/−four degrees (4°), this angle being referred to as alpha ("α") herein and noted in FIG. 3. A perpendicular offset 95 of the second end 90*b* of the long pipe nipple 90 from the pipe axis 25*c* is therefore equal to the length of the long pipe nipple 90 multiplied by sine(α). In the illustrated embodiment, the perpendicular offset 95 is horizontal because the pipe axis 25*c* is vertical.

Because the perpendicular offset 95 is a function of the length of the pipe nipple, it is magnified with a long pipe nipple 90 compared to a standard length pipe nipple. With a standard length pipe nipple, the perpendicular offset 95 is generally within an acceptable range in which the pipe connector 85 can be threaded onto the second end 90*b* of the long pipe nipple 90 because the standard length pipe nipple is relatively short. The perpendicular offset 95 of the long pipe nipple 90 can be too great for a smooth threaded interconnection (i.e., without damaging the threads) with the pipe connector 85 when the spud axis 35*c* is at a relatively large angle α.

As recognized by the inventors, the perpendicular offset 95 problem can be solved by either decreasing manufacturing tolerances when welding the spuds 35 to the tank wall to reduce the range of the angle α or by building some flexibility into the plumbing so that the pipe connectors 85 can be smoothly threaded onto a pipe nipple even when the angle α would result in too much perpendicular offset 95 for a long pipe nipple 90. Some embodiments of the present invention adopt the latter solution. A pipe nipple or similar structure that is not flexible and can bear and transmit a torque load is referred to generically as a "rigid connector" herein. The long pipe nipple 90 and standard length pipe nipples are rigid connectors, for example.

FIGS. 4-9, illustrate a second embodiment of the invention. The fluid connection assembly 110 is for use on a water heater 10 identical to that described above, with the fluid connection assemblies 110 replacing the long pipe nipples 90 of the first embodiment. The same reference numbers are used for the same features described above. Two fluid connection assemblies 110, one for the hot water side and one for the cold water side, are mounted to the water heater 10. The following description will focus only on one fluid connection assembly 110, it being understood that the description applies equally to both fluid connection assemblies 110.

The fluid connection assembly 110 includes a first pipe nipple 120, a second pipe nipple 130, a flexible connector 140, and a torque carrier 150. Each of these components of the fluid connection assembly 110 includes a first end (or side as the case may be) and a second end (or side as the case may be). In each case, the first end or side of a component is its lower end and the second end or side is its higher end when properly installed.

The first and second pipe nipples 120, 130 are general-use welded or seamless carbon steel pipe nipples manufactured to ASTM A733-16 standards. Either or both nipples may be zinc-coated, and may optionally be provided with a thermoplastic lining to prevent thread corrosion. The flexible connector 140 is a stainless steel corrugated tubing terminated at either end with nuts made of, for example, brass. It should be understood that the first and second pipe nipples 120, 130 and flexible connector 140 can alternatively be made of any other suitable material recommended by the manufacturer for a water application such as a water heater.

Turning to FIG. 5, the first and second pipe nipples 120, 130 are standard length (for example, four inch) pipe nipples. The first and second pipe nipples 120, 130 each include a first (lower) male threaded end 120*a*, 130*a* and a second (upper) male threaded end 120*b*, 130*b* and define a pipe nipple axis 120*c*, 130*c*. The ends 120*a*, 130*a*, 120*b*, 130*b* of the pipe nipples 120, 130 are typically tapered, widening from a relatively narrow dimension at the free ends to a wider dimension at the main central body. As such, the ends form a progressively tighter seal as they are threaded into female threads of the spuds 35 and pipe connectors 85. The first and second pipe nipples 120, 130 are rigid connectors that carry and transfer torque loads between their ends.

The flexible connector 140 is a length of flexible tubing having a first end nut 140*a* at its first end and a second end nut 140*b* at its second end. The end nuts 140*a*, 140*b* include female threads that are suitable for threading onto the male threads of the first and second pipe nipples 120, 130. By suitable is meant that the female threads of the end nuts 140*a*, 140*b* have a compatible thread pitch to the male threaded ends of the pipe nipples 120, 130, and a generally compatible diameter. In at least some embodiments, the female threads of the end nuts 140*a*, 140*b* are not tapered threads and do not form a fluid-tight seal to the tapered male threads of the pipe nipples. Rather, the fluid-tight seal between the flexible connector 140 and the pipe nipples 120, 130 in such embodiments is achieved by other means such as, for example, a compressible gasket that is inserted into the end nuts 140*a*, 140*b*.

The illustrated end nuts 140*a*, 140*b* are hex nuts with flat surfaces to facilitate tightening with a wrench. The flexible connector 140 is not a rigid connector but is instead flexible which means it does not carry or transfer significant torque loads between its ends. When unbent (straight) the flexible connector 140 defines a single linear longitudinal axis but the flexibility of the flexible connector 140 permits it to have a first end local longitudinal axis 140*c*' at the first end nut 140*a* that is not collinear with a second end local longitudinal axis 140*c*" at the second end nut 140*b*. In each case, the first and second end local longitudinal axes 140*c*', 140*c*" are collinear with the female threads 140*d* of the respective first and second end nut 140*a*, 140*b*.

During manufacturing and installation of the water heater 10, the first end 120*a* of the first pipe nipple 120 is threaded into the spud 35 and the first end nut 140*a* of the flexible connector 140 is threaded onto the second end 120*b* of the first pipe nipple 120, such that the spud axis 35*c*, first pipe nipple axis 120*c*, and first end local longitudinal axis 140*c*' are collinear and at the angle α with respect to the pipe axis 25*c*. The first pipe nipple 120 extends through the jacket through-hole 40*c* and into the component space 65. The first pipe nipple 120 is rigidly mounted to the spud 35 in the sense that the first pipe nipple 120 cannot be bent or flexed to make the first pipe nipple axis 120*c* non-collinear with the spud axis 35*c* because of the threaded interconnection and the rigidity of the first pipe nipple 120. The flexible connector 140 spans the gap 70 in the component space 65 between the first pipe nipple 120 and the second pipe nipple 130.

After the first end nut 140*a* of the flexible connector 140 is threaded onto the second end 120*b* of the first pipe nipple 120, the flexible connector 140 is bent and manipulated so that the second end local longitudinal axis 140*c*" will be collinear with the pipe axis 25*c* when the water heater 10 is installed. The second end nut 140*b* passes through the shroud through-hole 45*c* and is received in the torque carrier 150, as will be described in more detail below. Then the first end 130*a* of the second pipe nipple 130 is threaded into the second end nut 140*b* of the flexible connector 140 such that the second pipe nipple axis 130*c* will also be collinear with the pipe axis 25*c*. The second pipe nipple 130 is outside of the component space 65. Then the pipe connector 85 is threaded onto the second end 130*b* of the second pipe nipple 130. The first end of the flexible connector 140 therefore defines a non-collinear axis (i.e., the first end local longitudinal axis 140*c*' at angle α with respect to the pipe axis 25*c*) and the second end of the flexible connector 140 defines a collinear axis (i.e., the second end local longitudinal axis 140*c*" collinear with the pipe axis 25*c*).

The term "collinear with" when referring to the pipe axis 25*c*, second pipe nipple axis 130*c*, and second end local longitudinal axis 140*c*" means within a range of positions and angles that permit smooth threaded engagement of the pipe connector 85 onto the second end 130*b* of the second pipe nipple 130. With these threaded connections complete, fluid communication is established between the pipe 25 and the interior space 30*d* of the tank 30 through the fluid connection assembly 110 and the spud 35. The installer can solder or otherwise affix the pipe connector 85 to the pipe 25 to provide a leak-free connection of the water heater 10 to the source 15 and the end user outlets 20.

During the aforementioned manufacturing steps, the second end local longitudinal axis 140*c*" can be made to be collinear with the pipe axis 25*c* by, for example, using appropriate fixturing to orient and locate the second end nut 140*b*. For example, the torque carrier 150 can be used as a fixturing mechanism to ensure that the second end local longitudinal axis 140*c*" is oriented perpendicular to the top surface of the shroud top 45*b*, as will be described.

Figure 6:
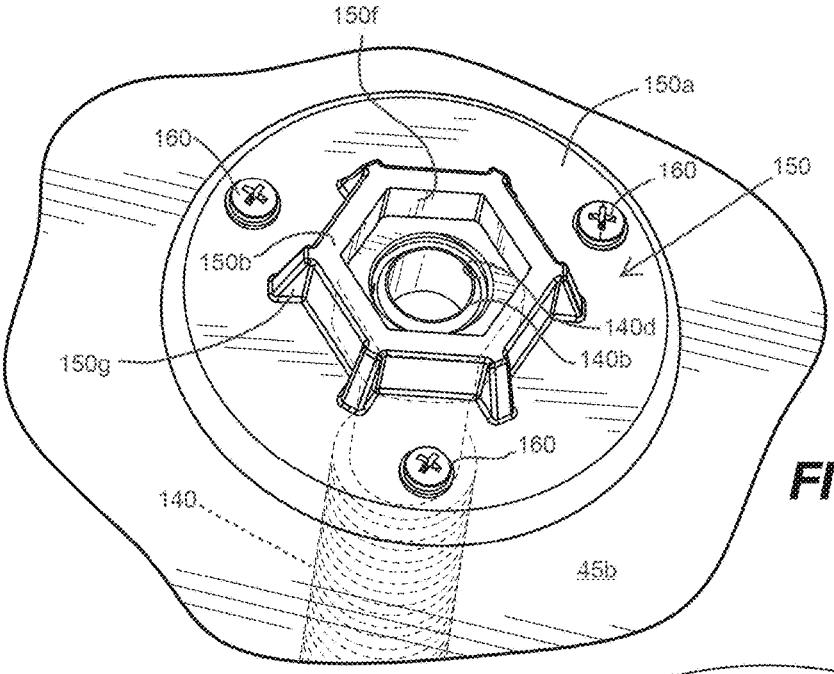
FIG. 6 an external perspective view of a torque carrier of the second embodiment mounted to a water heater shroud.
Figure 7:
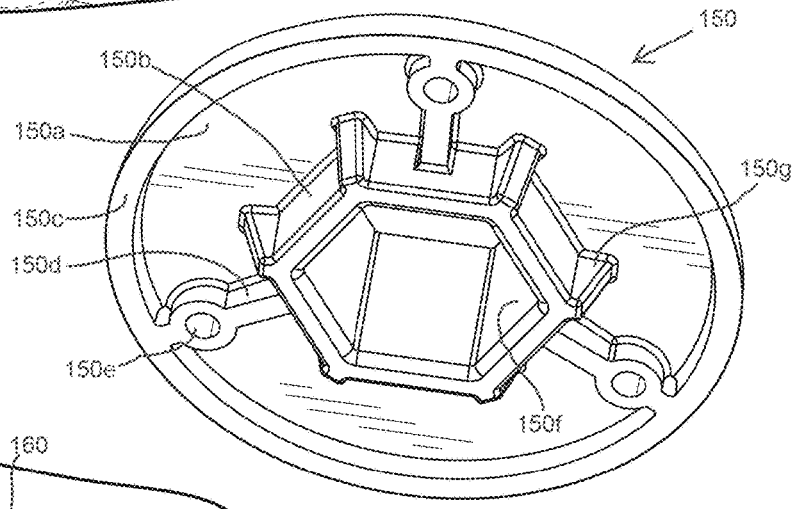
FIG. 7 is a bottom perspective view of the torque carrier of the second embodiment.
Figure 8:
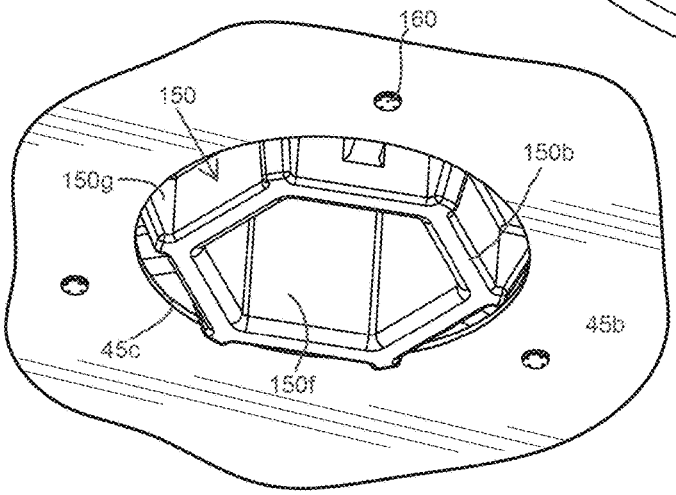
FIG. 8 is an internal perspective view of the torque carrier of the second embodiment mounted to the water heater shroud.
Figure 9:
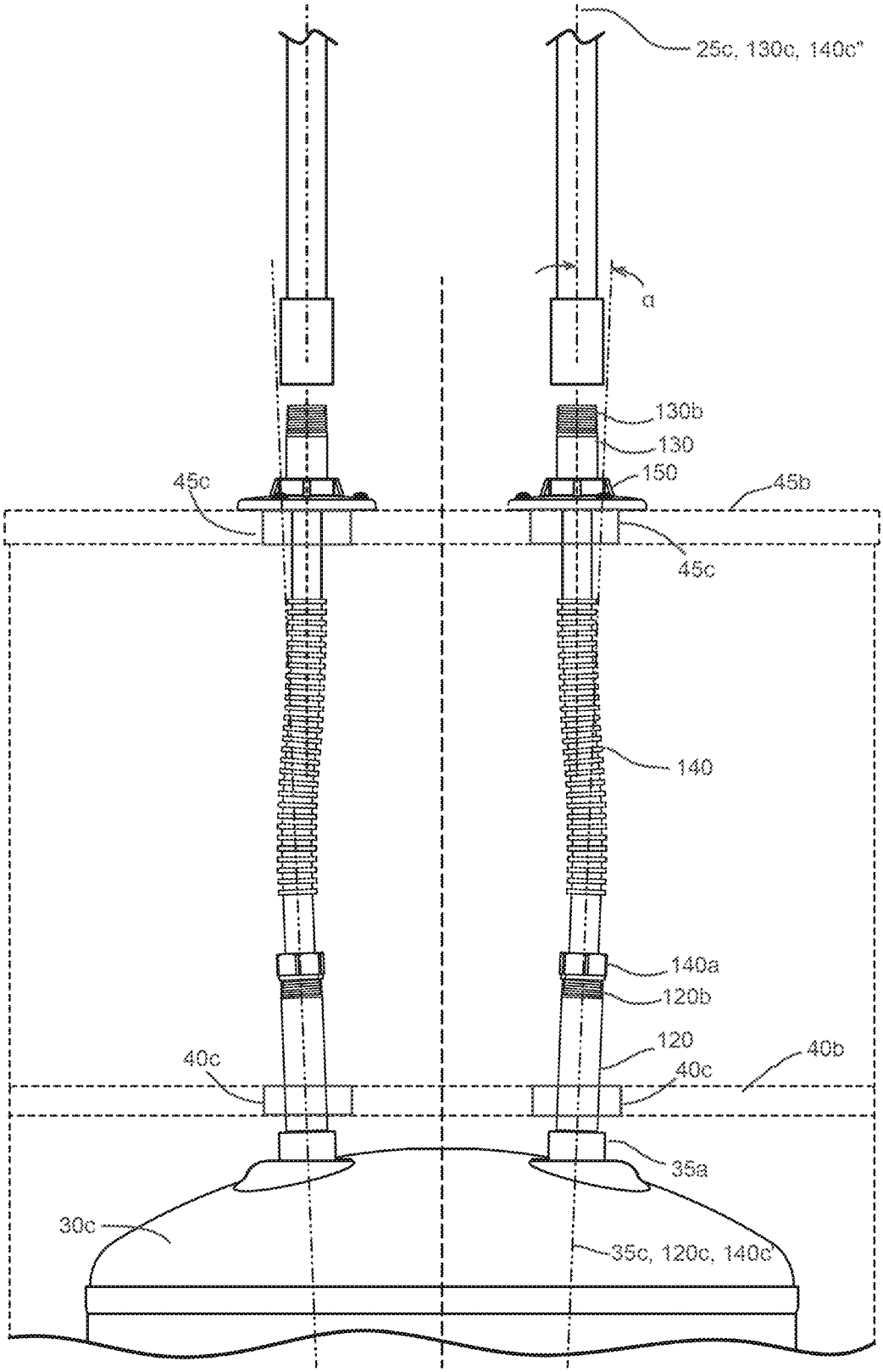
FIG. 9 is a side view of an assembly step of the second embodiment.

As seen in FIGS. 6-8, the torque carrier 150 provides a load path that bears torque applied to the second end nut 140*b* of the flexible connector 140 while the second pipe nipple 130 is threaded into it. The torque carrier 150 includes a base 150*a* and a sleeve 150*b* centered on (collinear with) the pipe axis 25*c*. The base 150*a* is disc shaped and is generally flat and planar. The base 150*a* has a first side that lies against or confronts the shroud top 45*b* and a second side that faces outwardly toward the pipe connector 85. A circumferential rim 150*c* extends around the circumference of the first side of the base 150*a* and radial ribs 150*d* extend radially along the first side of the base 150*a* between the sleeve 150*b* and the circumferential rim 150*c*. The circumferential rim 150*c* and radial ribs 150*d* provide stiffness to the base 150*a* and sleeve 150*b*. The base 150*a* also includes multiple (three in the illustrated embodiment) mounting holes 150*e* for rigidly mounting the torque carrier 150 to the outer surface of the shroud top 45*b* over the shroud through-hole 45*c*. The mounting holes 150*e* extend through the radial ribs 150*d*. Fasteners 160 extend through the mounting holes 150*e* and are threaded into the shroud top 45*b* to rigidly mount the torque carrier 150 to the shroud top 45*b*.

The sleeve 150*b* extends in opposite directions from the first and second sides of the base 150*a* perpendicular to the base 150*a*. More specifically, the sleeve 150*b* extends perpendicular to the base 150*a* in a first direction (i.e., down) through the shroud top 45*b* (i.e., through the shroud through-hole 45*c*) and into the component space 65 and also extends perpendicular to the base 150*a* in a second direction (i.e., up) toward the pipe connector 85. The sleeve 150*b* defines multiple internal loadbearing surfaces or flats 150*f*. In the illustrated embodiment, the internal surface of the sleeve 150*b* is hexagonal with six loadbearing surfaces 150*f* and can be referred to as a "hex socket." The loadbearing surfaces 150*f* are sized to receive the second end nut 140*b* of the flexible connector 140. Engagement of the six flat sides of the second end nut 140*b* with the six loadbearing surfaces 150*f* of the sleeve 150*b* prevents rotation of the second end nut 140*b* within the sleeve 150*b* and with respect to the shroud top 45*b*. Multiple gussets 150*g* extend between the sleeve 150*b* and the base 150*a* on both sides. The torque carrier 150 is integrally formed of a glass-filled nylon as a single piece, by injection molding for example, such that the base 150*a*, sleeve 150*b*, circumferential rim 150*c*, radial ribs 150*d* and gussets 150*g* are all integrally formed with each other as a single, rigid structure.

In at least some embodiments, the assembly of the fluid connection assembly 110 can be simplified by fastening the torque carrier 150 to the shroud top 45*b* after having received the second end nut 140*b* into the torque carrier 150. To practice this assembly method, the shroud top 45*b* is left off the shroud sidewall 45*a* (i.e., the shroud 45 is open-topped) as the components are first assembled within the shroud 45. Such assembly includes threading the first pipe nipple 120 into the spud 35 and threading the first end nut 140*a* onto the second end 120*b* of the first pipe nipple 120 such that the second end nut 140*b* is a free end of the flexible connector 140 (i.e., the second end nut 140*b* is not connected to anything at this point in the assembly). The shroud top 45*b* can then be secured to the top of the shroud sidewall 45*a* to close off the component space 65, with the second end nut 140*b* extending at least partway through the shroud through-hole 45*c*. The sleeve 150*b* of the torque carrier 150 is then installed on the second end nut 140*b* with the sleeve 150*b* extending into the shroud through-hole 45*c* and the base 150*a* disposed flat against the shroud top 45*b*. The fasteners 160 are then inserted through the mounting holes 150*e* and screwed into the shroud top 45*b* to secure the torque carrier 150 to the shroud top 45*b*. The shroud through-hole 45*c* can be sized to be substantially larger than the second end nut 140*b* to allow for easy assembly without sacrificing the positional accuracy of the second end local longitudinal axis 140*c*", since the torque carrier 150 base 150*a* and sleeve 150*b* can be sized to accurately center the second end local longitudinal axis 140*c*" within the shroud through-hole 45*c*. This method takes advantage of the shroud through-hole 45*c* being relatively large compared to the sleeve 150*b* so it is easier to fish the second end nut 140*b* through the shroud top 45*b* during assembly compared to the difficulty of precisely locating the second end nut 140*b* in the sleeve 150*b* while securing the shroud top 45*b* onto the shroud sidewall 45*a* if the torque carrier 150 were pre-attached to the shroud top 45*b*.

The first end 130*a* of the second pipe nipple 130 is threaded into the second end nut 140*b*, such that the manufacturer may sell the water heater 10 with the first end 120*a* of the first pipe nipple 120 threaded into the spud 35, the first end nut 140*a* of the flexible connector 140 threaded onto the second end 120*b* of the first pipe nipple 120, the second end nut 140*b* received in the sleeve 150*b*, and the second pipe nipple 130 threaded into the second end nut 140*b*. This allows the manufacturer to present the water heater 10 to an installer in a manner that is similar to that of water heaters without a top shroud, which have short pipe nipples extensions through the jacket top to which the pipes 25 can be connected. The installer of the water heater 10 can therefore simply thread the pipe connector 85 onto the second end 130*b* of the second pipe nipple 130 and solder the pipe connector 85 to the pipe 25 to place the pipe 25 in fluid communication with the interior space 30*d* of the tank 30. This can be done without removing the shroud 45 or directly accessing the spuds 35. The flexible connector 140 therefore enables establishment of the fluid communication between the pipe 25 and the interior space 30*d* of the tank 30 from outside of the shroud 45 during installation. Alternatively, the manufacturer can sell the water heater 10 without the second pipe nipple 130, and the installer can select and install a pipe nipple of appropriate length during the installation process, still without a need to remove the shroud 45.

The loadbearing surfaces 150*f* of the sleeve 150*b* are broad and strong compared to the relatively thin gauge material of the shroud top 45*b*. The torque carrier 150 provides a load path between the second pipe nipple 130 and the shroud top 45*b*, such that torque applied to the second end nut 140*b* of the flexible connector 140 while attaching the second pipe nipple 130 is distributed to the shroud top 45*b* without tearing, bending, or otherwise damaging the shroud top 45*b*. More specifically, the load path between the second end nut 140*b* and the shroud top 45*b* includes the sleeve 150*b*, the gussets 150*g*, the base 150*a*, the circumferential rim 150*c*, the radial ribs 150*d*, and the fasteners 160. The torque carrier 150 eliminates the need for applying a wrench to the second end nut 140*b* during installation of the second pipe nipple 130. The torque carrier 150 and its mounting configuration to the shroud top 145*b* can be configured to bear torque loads of at least twelve ft-lbs., for example, in order to achieve a leak-free connection at the compressible gasket housed within the end nut 140*b*. In some embodiments, the torque carrier 150 is configured to bear higher torque loads (e.g. fifty ft-lbs. or more) in order to effect a leak-free connection using, for example, tapered pipe threads.

Figure 10:
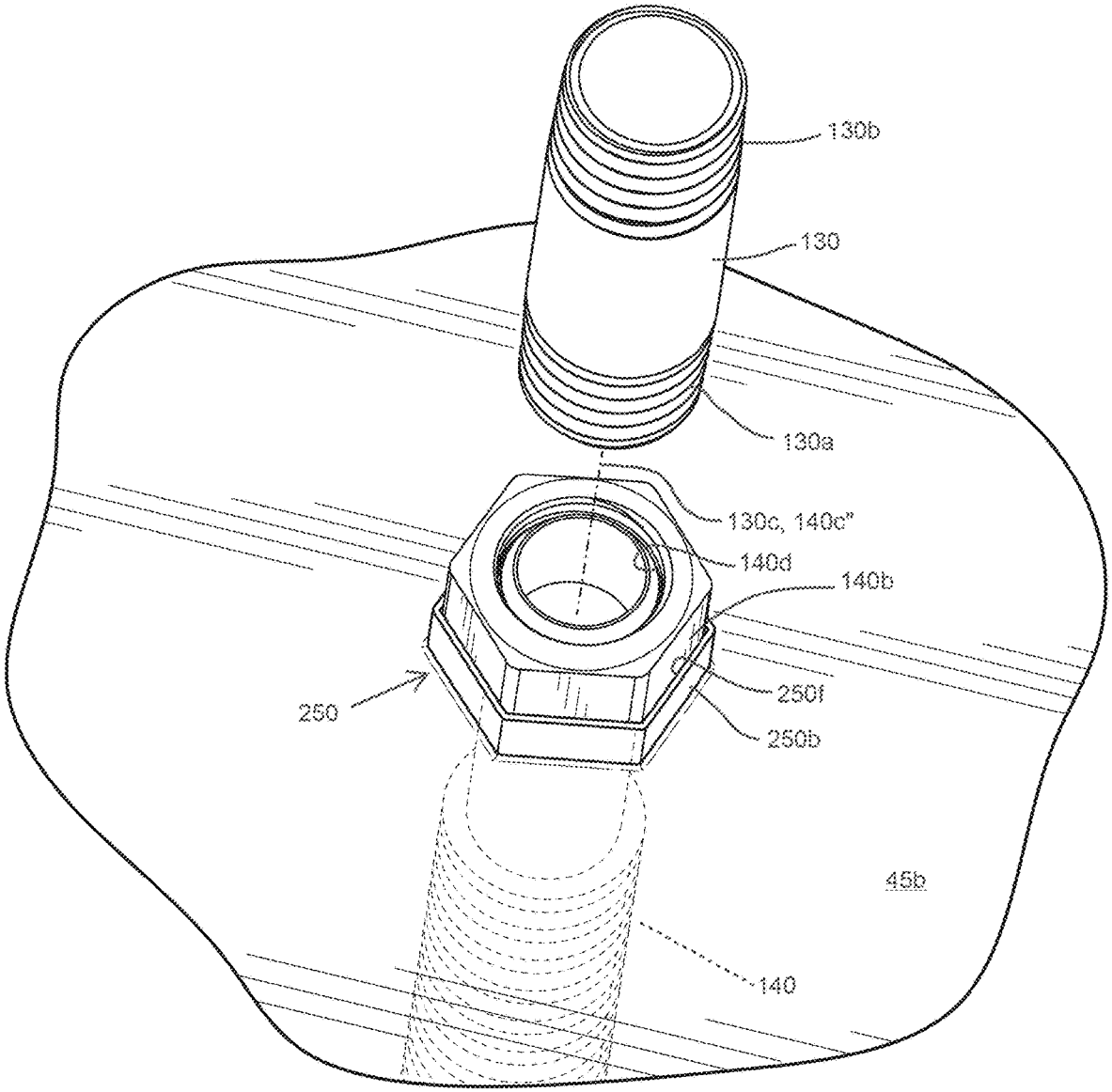
FIG. 10 is an external perspective view of a torque carrier of a third embodiment of the invention integrally formed with a water heater shroud.

FIG. 10 illustrates a third embodiment of a water heater. In the third embodiment, the water heater 10 includes a torque carrier 250, which is integrally formed with the shroud top 45*b*. The shroud top 45*b* serves as the base of the torque carrier 250. Material of the shroud top 45*b* is molded, punched, drawn, or bent upward to form a sleeve 250*b*. The sleeve 250*b* in this embodiment is functionally identical to the sleeve 150*b* of the first embodiment 150 and includes loadbearing surfaces or flats 250*f* serving the same purpose as the loadbearing surfaces 150*f* in the first embodiment.

In some embodiments, the torque carrier is formed using a dielectric material (for example, a plastic material). The dielectric material is configured to provide galvanic isolation between the fluid conduits (e.g. the pipe 25, the pipe connector 85, the pipe nipples 120, 130, the flexible connector 140, and the tank 30) and the outer jacket 40 or the shroud 45. In other embodiments, the torque carrier includes a dielectric isolator bushing.

Figure 11:
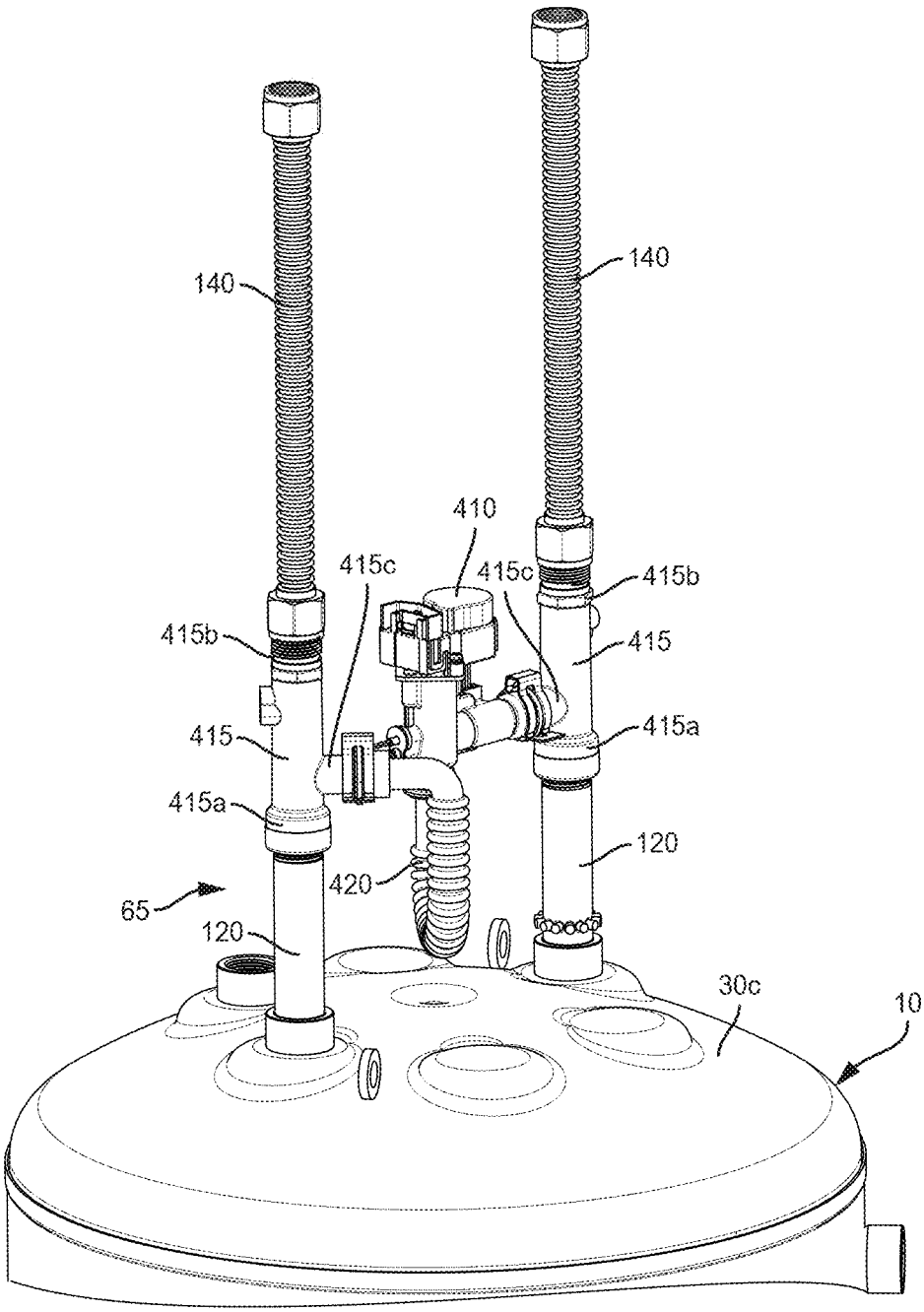
FIG. 11 is a top perspective view of a top portion of a tank-type water heater according to a fourth embodiment of the present invention.

FIG. 11 illustrates a fourth embodiment of a water heater 10. In the fourth embodiment, the component in the component space 65 comprises a mixing valve 410. In this embodiment, a three port connector 415 is interposed between the first pipe nipple 120 and the flexible connector 140 on both the hot side and the cold side, a first end of the three port connector 415 comprises a first port 415*a* and a second end comprises a second port 415*b*. A third port 415*c* on a side of the three port connector 415 communicates with the mixing valve 410 directly or via a flexible conduit 420. As a result, an inlet and an outlet of the mixing valve 415 each communicate with the third port 415*c* of one of the three port connectors 415.

By connecting the port 415*a* of a three port connector 415 to the end 120*b* of a first pipe nipple 120, the three port connector 415 becomes part of the rigid connector extending from the tank 10. The rigid connector comprising the pipe nipple 120 and the attached three port connector 415 is capable of bearing a torque load, so that the first end nut 140*a* of the flexible connector 140 can be attached to the port 514*a* in a similar manner as it was described connecting to the end 120*b* in the second embodiment.

The mixing valve 410 draws cold water from the cold water pipe 25*a* and mixes the cold water into hot water flowing from the tank 30 to the hot water pipe 25*b* when the temperature of the hot water coming out of the tank 30 exceeds a preset high limit temperature or to achieve a desired water temperature called for at the point of use. The water route from the cold water side to the hot water side, including the mixing valve 410 and the flexible conduit 420, is referred to as a bypass line. The configuration illustrated in FIG. 11 can be used in any of the previously-described embodiments.

Thus, the invention is to cover all modifications, equivalents, and alternatives falling within the spirit and scope of the invention as defined by the following claims.

What is claimed is:

1. A water heater plumbing connection system, comprising:

a top surface of a water heater;

a torque carrier secured to the top surface of the water heater;

a fluid connection assembly having a first portion arranged within the torque carrier and a threaded end arranged outside of the torque carrier; and a plurality of fasteners that secure the torque carrier to the top surface, wherein a connection between the plurality of fasteners and the top surface is configured to resist a torque applied to the threaded end of the fluid connection assembly during an installation of the water heater.

2. The water heater plumbing connection system of claim 1, wherein the first portion comprises a hex nut, the hex nut being configured to transfer said torque from the threaded end of the fluid connection assembly to the torque carrier.

3. The water heater plumbing connection system of claim 2, wherein the torque carrier comprises a sleeve having a hexagonal shaped internal surface to receive the hex nut.

4. The water heater plumbing connection system of claim 3, wherein the top surface comprises a circular aperture, wherein the fluid connection assembly has a central axis, and wherein each one of the plurality of fasteners is spaced away from said central axis by a distance greater than a radius of the circular aperture.

5. The water heater plumbing connection system of claim 1, wherein the plurality of fasteners comprises at least three fasteners.

6. The water heater plumbing connection system of claim 1, wherein the torque carrier includes a sleeve and a base extending radially away from sleeve, and wherein the base is mounted to the top surface.

7. The water heater plumbing connection system of claim 6, wherein the torque carrier includes a plurality of gussets that extend between the sleeve and the base.

8. The water heater plumbing connection system of claim 6, wherein the base includes a circumferential rim, and wherein radial ribs extend between the sleeve and the circumferential rim.

9. The water heater plumbing connection system of claim 8, wherein the base includes mounting holes for receiving the plurality of fasteners, and wherein the mounting holes extend through the radial ribs.

10. The water heater plumbing connection system of claim 9, wherein the base includes a first side that faces the top surface and a second side opposite of the first side, and wherein the first side includes the radial ribs and the second side is generally planar.

11. The water heater plumbing connection system of claim 1, wherein the top surface of the water heater includes a second torque carrier secured to the top surface of the water heater via a second plurality of fasteners.

12. The water heater plumbing connection system of claim 1, wherein the torque carrier is formed using a dielectric material configured to provide galvanic isolation between the fluid connection assembly and the top surface of the water heater.

13. The water heater plumbing connection system of claim 1, wherein the threaded end of the fluid connection assembly is a first threaded end, the fluid connection assembly having a second threaded end spaced away from the first threaded end and threaded into a tank spud of the water heater.

14. The water heater plumbing connection system of claim 13, wherein the first threaded end defines a first longitudinal axis and the second threaded end defines a second longitudinal axis, wherein an angle defined between the second longitudinal axis and the first longitudinal axis is greater than zero degrees.

15. A water heater plumbing connection system, comprising:

a shroud top of a water heater at least partially defining a component space;

a torque carrier arranged at a top surface of the shroud top, the torque carrier defining a plurality of loadbearing surfaces; and a fluid connection assembly extending through the torque carrier and comprising a threaded end arranged outside of the component space, wherein a torque applied to the threaded end during installation of the water heater is distributed to the shroud top by way of the plurality of loadbearing surfaces.

16. The water heater plumbing connection system of claim 15, wherein the torque carrier is integrally formed with the shroud top.

17. The water heater plumbing connection system of claim 15, wherein the torque carrier is joined to shroud top by a plurality of fasteners and wherein the torque is distributed from the plurality of loadbearing surfaces to the shroud top by way of the plurality of fasteners.

18. The water heater plumbing connection system of claim 17, wherein the torque carrier comprises a flat base portion joined to the shroud top and a sleeve portion extending from the flat base portion, the plurality of loadbearing surfaces being arranged within the sleeve portion.

19. The water heater plumbing connection system of claim 15, wherein the plurality of loadbearing surfaces define a hexagonal shape.

* * * * *